United States Patent [19]

Chapman

[11] Patent Number: 4,649,785

[45] Date of Patent: Mar. 17, 1987

[54] MUSICAL TIMBRE MODIFICATION METHOD

[76] Inventor: Emmett H. Chapman, 8320 Yucca Trail, Los Angeles, Calif. 90046

[21] Appl. No.: 140,577

[22] Filed: Apr. 15, 1980

[51] Int. Cl.[4] ..... G10H 1/02

[52] U.S. Cl. ..... 84/1.19; 84/DIG. 9

[58] Field of Search ..... 84/1.19, 1.21, 1.24, 84/1.22, DIG. 9, 1.11

[56] References Cited

U.S. PATENT DOCUMENTS 3,974,461 8/1976 Luce ..... 84/1.11
4,106,384 8/1978 Whittington et al. ..... 84/1.19
4,236,434 12/1980 Nishibe ..... 84/1.19
4,244,261 1/1981 Adachi ..... 84/1.24

*Primary Examiner*—Forester W. Isen
*Attorney, Agent, or Firm*—J. E. McTaggart

[57] ABSTRACT

For amplified musical instruments such as electric guitars, this method of extending the range of timbre variation available from a "wah" type of pedal controlled sound modification effect provides musicians with increased flexibility of expression by including within the controlling range of the foot pedal an unmodified "dry" condition in addition to the variable modified condition with the capability of blending smoothly back and forth between the two conditions.

4 Claims, 2 Drawing Figures

MUSICAL TIMBRE MODIFICATION METHOD

BACKGROUND OF THE INVENTION

This invention relates to the field of electronic musical instruments, in particular electric guitars and the like associated with electronic amplification, where a musician playing an instrument wishes to manipulate variations in the timbre of notes played. More particularly, this invention relates to a method of modifying the frequency response of a musical instrument amplification system by means of a sensor actuated by the musician playing the instrument, to provide the musician with expression control thorugh a continuously variable range of frequency response shapes including a condition of essentially flat frequency response.

It is well known to modify the electrical sound output from an electric guitar or the like by means of electronic circuits controlled by a foot pedal sensor. Such pedal sensors and related electronics circuits are referred to as "effects pedals". An effect pedal is customarily equipped with a foot operated switch, called a "bypass" switch for cancelling the modified sound when it is desired to revert to normal "dry" sound having a substantially flat frequency response for reproducing the original sound unmodified. The bypass switch is not intended to be operated during the performance of musical passages, since the switching is abrupt and musically disruptive. Consequently, such switching normally must be avoided by the musician during performance of a continuous musical passage.

The present invention originates from the discovery that the variety of expression available from an ordinary effect pedal could be extended and enhanced by including within the range of the pedal, the "dry" flat frequency response condition, and providing the ability to blend smoothly to the modified effect using the pedal, thereby eliminating the bypass switch as a separate entity, but retaining its function, not merely as an option to be selected between musical performances, but as a distinctively expressive element continuously variable during musical performance.

SUMMARY OF THE INVENTION

By introducing into the audio-signal path, between a musical instrument and an amplifier, a controlling circuit activated from a sensor such as a foot pedal manipulated by the musician, and programming the controlling circuit to provide, in addition to special effects available over the major portion of the control range of the pedal, a "dry" flat frequency response condition at one end of the control range of the pedal, this invention expands the range of musical expression available from an effects pedal while eliminating the need for a bypass switch with its inherant limitations.

In one embodiment of this invention which has proven particularly beneficial, the modification effect is of the class referred to as a "wah" or "wah-wah" effect, where the sound of the word "wah" simulates the varying timbre of a musical note as the pedal is depressed. The "wah" effect is producedd by varying the peak frequency of a single resonant peak or formant in the controlling circuit's frequency curve. In this embodiment of this invention, a preferred mode of pedal control was achieved by programming the controlling circuit so that with no pressure applied to the pedal, the "dry" flat response condition is available. Then, as the pedal is depressed, a low frequency peak gradually appears in the response; and then as the pedal is further depressed the frequency of the peak is caused to increase.

It is an object of this invention to provide musicians with a method of controlling sound modification by introducing variations in the frequency response of an electronic musical instrument by means of a controlling circuit programmed to include a substantially flat frequency "dry" condition in addition to a variable modified sound effect within one continuously variable pedal sensor range, to enable a musician to blend smoothly between the "dry" and the modified sound as a musically expressive performance technique.

It is a further object of this invention to eliminate the need for a bypass switch on an effect pedal by including the bypass function within the continuous control range of the pedal sensor action.

Further objects and advantages of this invention will become apparent from the study of the following portion of the application, the claims and the attached drawings.

Auxiliary output 9 from controlling circuit 3 may be provided as an optional extra feature, to make available the unmodified "dry" audio signal from guitar 1, with controlling circuit 3 further programmed to enable pedal sensor 2 to function as a volume control with respect to output 9.

DESCRIPTION OF THE ILLUSTRATIVE EMBODIMENT

Figure 1:
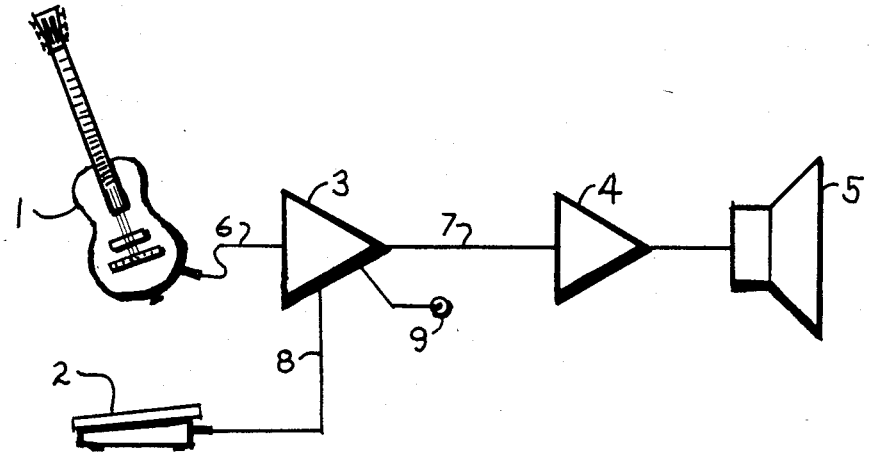
FIG. 1 shows a block diagram of a preferred embodiment of this invention. An electric guitar 1 has its output connected by cable 6 to the audio input of a controlling circuit 3 which has also a control input connected by cable 8 from a foot pedal sensor 2. The output of controlling circuit 3 is connected by cable 7 to the input of amplifier 4 which drives loudspeaker 5.

Referring to FIG. 1, controlling circuit 3 is housed in a separate enclosure and is connected to guitar 1 and amplifier 4 by standard shielded audio cables 6 and 7 respectively. The output from amplifier 4 is converted to audible sound by loudspeaker 5 as commonly practiced. Foot pedal sensor 2 comprises a pressure sensitive resistive element connected to develop a varying d.c. control voltage proportional to pressure applied to the pedal. This d.c. control voltage is applied to controlling circuit 3 through ordinary wiring cable 8. It is within the competence of those skilled in the present state of the art of electronic circuit design to configure and program the controlling circuit 3 to accomplish the response characterized by the curves of FIG. 2.

Figure 2:
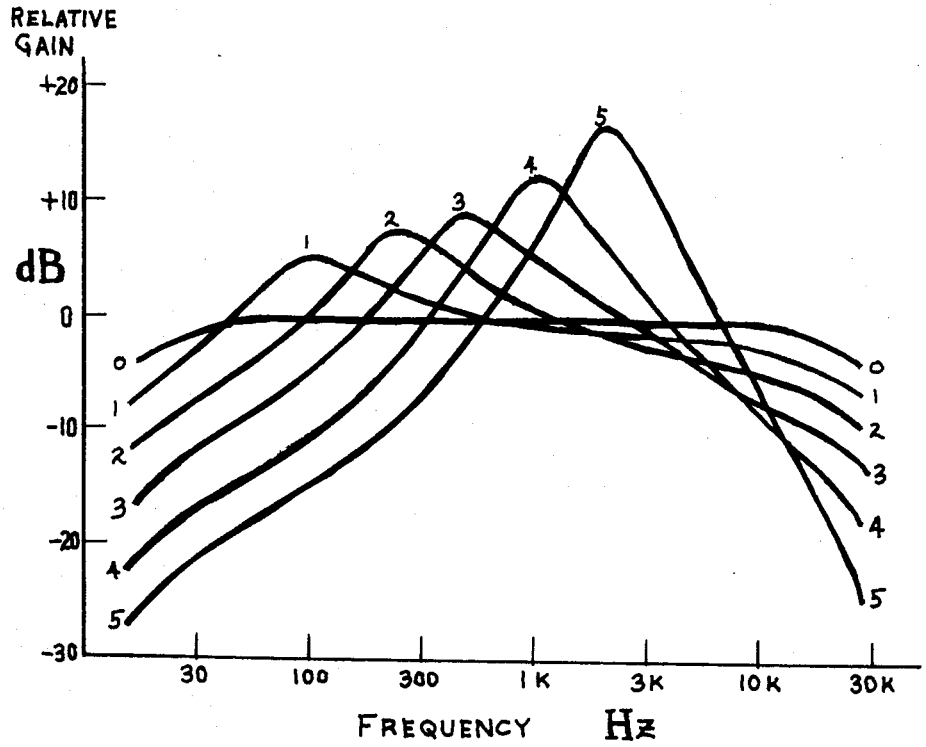
FIG. 2 shows a family of audio frequency response curves characterizing the way in which the controlling circuit 3 is programmed to cause foot pedal sensor 2 to act upon the output of guitar 1 according to the method of sound control taught by this invention in its preferred embodiment. The curves are numbered 0 through 5, corresponding with increasing pressure applied to foot pedal sensor 2 by a musician playing guitar 1. It will be noted that Curve 0, which corresponds to the condition of no pressure applied to the pedal sensor, is substantially flat across the useful frequency range, producing an unmodified natural or "dry" sound. Then as the pedal is depressed to ˚20% of its total range, as shown in Curve 1, a low frequency resonant peak begins to appear in the response. Further pressure on the pedal causes the frequency of the peak to increase as shown in Curves 2, 3, 4, and 5. It should be understood that the transitions between each of the curves shown occur smoothly and continously, as a function of each pedal depression.

A musician playing guitar 1 without placing his foot on pedal 2 will obtain the original sound of the guitar, since the frequency response of the controlling circuit 3 is flat as shown in Curve 0 of FIG. 2. At any time he can introduce the "wah" effect, as gradually as he wishes, by depressing pedal 2 with his foot. Once introduced, the "wah" pedal effect may be used in a customary manner, as he varies the peak frequency by means of his foot pressure, according to Curves 1 through 5 in FIG. 2. However, at any time, by reducing his foot pressure sufficiently he can execute smooth excursions back into the flat frequency response "dry" condition shown in Curve 0 of FIG. 2. This freedom to blend smoothly and fluently back and forth between the "dry" and the "wah" conditions places at the command of the musician an expanded range of timbre variation and resulting sound nuances for enriching his musical vocabulary; performance heretofore unattainable with conventional "wah" type effects pedals.

To achieve a distinctive mode of performance desired in the preferred embodiment of this invention, the particular contours and levels of Curves 0 through 5 of FIG. 2 were evolved to satisfy two basic criteria;

(a) to maximize the range of frequency response shape alteration and consequent timbre variation available, and (b) to minimize variations in subjective loudness of sound output from loudspeaker 5, over the pedal control range, for musical content typical of guitars and similar stringed instruments: thus in effect, to prevent the pedal from acting as a volume control over any part of its range.

Hence, in the programming of the controlling circuit 3 of FIG. 1, the shapes of Curves 1 through 5 of FIG. 2 satisfy criteria (a), while the assigned levels of these curves relative to each other and to Curve 0 achieve a substantial degree of subjective uniformity of loudness over the pedal, control range, to satisfy criteria (b).

The particular type of pedal mechanism employed in the preferred embodiment of this invention is pressure sensitive, operates through its entire range with no appreciable travel of its treadle surface, and returns automatically to a starting condition corresponding to Curve 0 of FIG. 2 whenever applied pressure is removed from the treadle surface of the pedal. It is obvious that other pedal constructions could be used with this invention, for example a common type having a pivoted treadle part with moves through a considerable angle of rotation throughout its range, and which may be friction loaded so as to retain a particular setting after the player's foot is removed rather than returning automatically to a starting condition.

This invention is susceptable of various modifications and alternatives, such as the substitution of other musical sound modifications effects, for example, "phase shifters", "flangers", "chorus effects" and the like in place of the "wah" effect described in this embodiment: the spirit and scope of this invention is intended to include all such modifications, alternatives an equivalents.

What is claimed is:

1. In a sound amplification system for electrical musical instruments, a method of modifying resultant timbre which comprises (a) deriving an electrical control signal, responsive to manipulation of a single sensor by a musician playing an instrument in conjunction with an electronic amplification system comprising an amplifier and a controlling circuit connected between the instrument and the amplifier, the controlling circuit being capable of varying the frequency response of the system, (b) applying the derived control signal to an input of the controlling circuit, and (c) programming the controlling circuit to respond to the control signal so as to vary the shape of the system frequency response over a range of smoothly variable shapes including a condition wherein the response shape is substantially flat over a full musical frequency range, and apart from the substantially flat frequency response condition, the frequency response is characterized as having a predominant resonant peak at a frequency which may be varied by the musican according to pressure applied by him to said single sensor.

2. The invention as recited in claim 1 wherein the controlling circuit is programmed such that: with no pressure applied to the sensor, the response shape is made to be essentially flat; then, as light pressure is applied to the sensor, the response shape is made to develop a resonant peak at relatively low frequency; and then as still further pressure is applied to the sensor, the frequency of the resonant peak is made to increase.

3. The invention as recited in claim 1 wherein the controlling circuit is further programmed to provide additionally (an auxiliary unmodified signal) at the output of an auxiliary audio channel having substantially flat frequency response over a full musical frequency range, an auxiliary unmodified signal, controllable in amplitude by manipulation of the sensor.

4. The invention as recited in claim 1 wherein the controlling circuit is programmed to cause the gain at the peak frequency in the modified response condition to be higher than the gain in the flat response condition and to increase with increasing peak frequency, and to cause the gain at the lower and upper ends of the musical audio frequency spectrum to be lower in the modified response condition than in the flat response condition, whereby compensation is provided to minimize variations in subjective loudness as the sensor is operated throughout its control range in the performance of music containing a wide band spectrum of audio energy.

* * * * *